United States Patent [19]

Weinke et al.

[11] 4,044,882

[45] Aug. 30, 1977

[54] APPARATUS FOR MOVING A PRINTER CARRIAGE

[75] Inventors: Robert Weinke, Munich; Georg Wiesmeier, Weidach, both of Germany

[73] Assignee: Siemens Aktiengesellschaft, Berlin & Munich, Germany

[21] Appl. No.: 613,475

[22] Filed: Sept. 15, 1975

[30] Foreign Application Priority Data

Sept. 20, 1974 Germany ..... 2445081

[51] Int. Cl.[2] ..... B41J 19/30

[52] U.S. Cl. ..... 197/82; 197/66

[58] Field of Search ..... 197/1 R, 60, 65, 66, 197/82, 89; 101/93.15, 93.16, 93.17; 318/696

[56] References Cited

U.S. PATENT DOCUMENTS

| | | | |
|---|---|---|---|
| 3,292,530 | 12/1966 | Martin | 197/1 R X |
| 3,707,214 | 12/1972 | Ponzano | 101/93.16 X |
| 3,744,411 | 7/1973 | Becker | 101/111 |
| 3,805,138 | 4/1974 | Hilker | 318/696 |
| 3,845,850 | 11/1974 | Herr et al. | 197/1 R |
| 3,858,702 | 1/1975 | Azuma | 197/66 X |
| 3,882,988 | 5/1975 | Sloan et al. | 197/82 X |
| 3,884,339 | 5/1975 | Castoldi et al. | 197/53 |
| 3,886,459 | 5/1975 | Hufford et al. | 318/696 X |
| 3,902,584 | 9/1975 | Lee et al. | 197/133 R X |
| 3,910,395 | 10/1975 | Colglazier et al. | 197/1 R |

*Primary Examiner*—Ernest T. Wright, Jr.
*Assistant Examiner*—Paul T. Sewell
*Attorney, Agent, or Firm*—Hill, Gross, Simpson, Van Santen, Steadman, Chiara & Simpson

[57] ABSTRACT

A printer carriage as for a teleprinter or a typewriter is carried on a toothed belt along a printing row, the belt being driven in forward and reverse directions by a reversible stepping motor operating without feedback. Deceleration and precise stoppage of the carriage during carriage return movements are governed by fixed signal generators along the printing row and a ring counter in the motor control unit. Stoppage occurs upon coincidence of a signal from the ring counter and a signal from a generator at the row commence position, combined in a logical AND- circuit.

1 Claim, 4 Drawing Figures

APPARATUS FOR MOVING A PRINTER CARRIAGE

BACKGROUND OF THE INVENTION

1. Field of the Invention

The invention relates to an apparatus for moving a printer carriage for printer units, in particular for teleprinters and typewriters, in which the feed and return movements are produced by a drive motor having a reversible direction of rotation.

2. Prior Art

In printer units for teleprinters and typewriters, the printer carriage is generally moved along the platen to print-out individual characters. After print-out of the last character in a row, the printer carriage is returned in the shortest possible time to the beginning of the row. The printer carriage is moved in the forward or feed direction by a drive motor which constantly rotates in one direction and also tensions a carriage return spring. During the carriage return, the drive motor is cut off from the printer carriage at a coupling and the carriage return spring moves the carriage back to the beginning of the row where it is stopped by a shock absorber.

To mechanically simplify such carriage drives, the printer carriage, which slides on guide bars, has been secured to a toothed belt which is driven by a gear stage in the return direction by an electronically controlled d.c. motor having a reversible direction of rotation (see German Offenlegungschrift 2,263,283). The mechanical components of carriage return spring, shock absorber, and coupling can then be dispensed with. This type of drive with a d.c. motor has the disadvantage however, like any servo-drive arrangement, that rapid and accurate positioning of the printer carriage requires a costly feedback circuit, with scanning of each position of the carriage and an adjustment of the motor via such feedback circuit until a desired position is reached.

SUMMARY

A primary aim of the invention is to provide optimum movement sequences of a printer carriage during feed and return motions and to facilitate rapid and accurate positioning which does not require feed-back circuitry.

In accordance with the invention, a stepping motor is used as a drive motor, the ratio of the elements which transmit the motion of the motor to the printer carriage being such that during a forward movement of the printer carriage of one column, the motor executes several steps. During the carriage return the motor is operated in the opposite direction of rotation in its maximum torque range. A break in the pulse sequence controlling the stepping motor, required to stop the motor at the end of the carriage return, is triggered by an AND logic-linking element. A row commence signal emitted by a first signal generator arranged at the beginning of the row and a coincidence signal from a ring counter which controls the stepping motor are linked to one another in the logic element, the coincidence signal being emitted when a specific count is reached by the ring counter after emission of the row commence signal.

The stepping motor positions the printer carriage during the feed movement without feedback. When the printer carriage is advanced by one column, the motor executes several steps, so that the intervals of time between the control pulses of the motor can be selected so that the various movement states of the printer carriage are optimal. This applies to the acceleration, constant speed, deceleration, and stationary states of the printer carriage. Overshooting at the end of any movement is substantially avoided. During the carriage return movement the stepping motor is operated at an optimum load angle, and thus in its maximum torque range. The shortest carriage return time is thus achieved. To stop the printer carriage upon carriage return, a specific count of the ring counter which controls the stepping motor is analyzed. The pulse sequence which controls or drives stepping motor is not interrupted until the row-commence signal and such specific count occur simultaneously. This ensures a precisely stepped stopping of the motor. The tolerance range for setting of the signal generator for emission of the row-commence signal can be relatively large. The invention thus enables a rapid and accurate positioning of the printer carriage in all the movements between two row commencements. Additional operating functions (backspace, tabulator device forwards and backwards, variable column spacing for spacing adjustment) are easily provided by altering the input signals of the motor for rotation, direction and control frequency.

DESCRIPTION OF THE PREFERRED EMBODIMENTS

Figure 1:
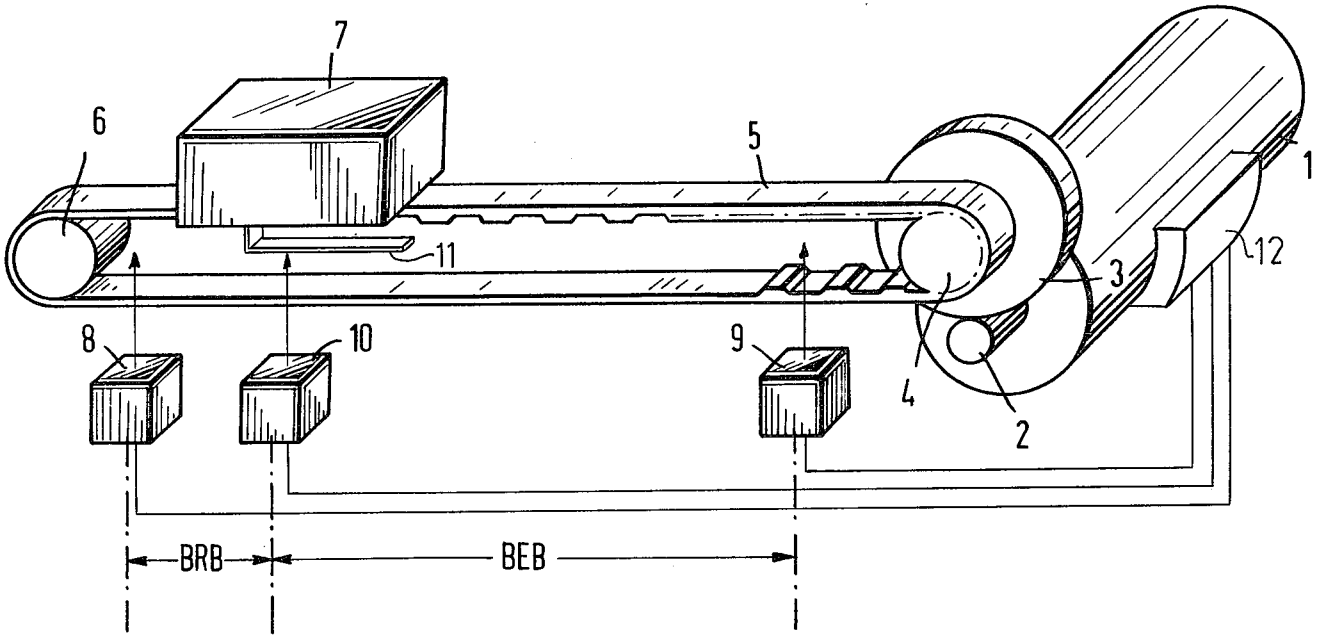
FIG. 1 is a partially schematic view of the layout of the device of the invention.

FIG. 1 shows the construction of the overall carriage drive. A pinion 2 is cut onto the shaft of a stepping motor 1 and engages a gear 3 mounted in a bearing bracket of the stepping motor 1. A drive wheel 4 is secured to this gear and drives an endless belt 5. The belt 5 is stretched between this drive wheel 4 and a toothless guide roller 6. The belt 5 is provided with teeth only in the part which during operation runs about the drive wheel 4, thus reducing friction in guiding the belt and lowering noise production. A printer carriage 7 is firmly connected to the upper part of the toothed belt 5 as shown. The carriage 7 moves on two guide bars, not shown.

Control of carriage movement and recognition of the carriage position both upon switching on of the device and during the carriage return are effected by a first signal generator 8 at the beginning of a printing row, a second signal generator 9 at the end of the row, and a third signal generator 10 arranged at a 12th column of the row. The third generator 10 provides a deceleration signal during the carriage return movement. The first signal generator 8 reports on a row commencement position of the printer carriage, the second signal generator 9 reports an end of row position and the third signal generator 10 reports that the printer carriage lies between the third and the first signal generators. To trigger operation of the three signal generators the printer carriage 7 is provided with a control strip 11 which also activates the third signal generator 10 to signal a control unit 12 of the stepping motor whenever the carriage is in a region BRB between the first and third signal generators. This region BRB is a deceleration region, and the region between the second signal generator 9 and the third signal generator 10, i.e. the region BEB, is an acceleration region, for carriage return. The control unit 12 comprises a timing pulse generator, a coincidence signal generator and an AND-logic circuit.

When the stepping motor rotates in a counter-clockwise direction, the carriage is moved forwardly. The ratio from the pinion 2 to the gear 3 is selected so that the carriage 7 is displaced by one printing column when the stepping motor 1 executes three steps.

For carriage return, the rotation direction of the stepping motor output 2 is reversed and the carriage is moved toward the row commencement position. A higher speed for carriage return, in comparison to the carriage feed, is achieved by raising the control frequency established in a timing pulse generator unit in control unit 12 of the stepping motor. Because loss of step position may occur upon sudden changes in control frequencies of the stepping motor, it is necessary to control or govern return movement of the carriage by signal generators. In this return movement it is necessary to differentiate between two situations, depending on carriage position.

Figure 2:
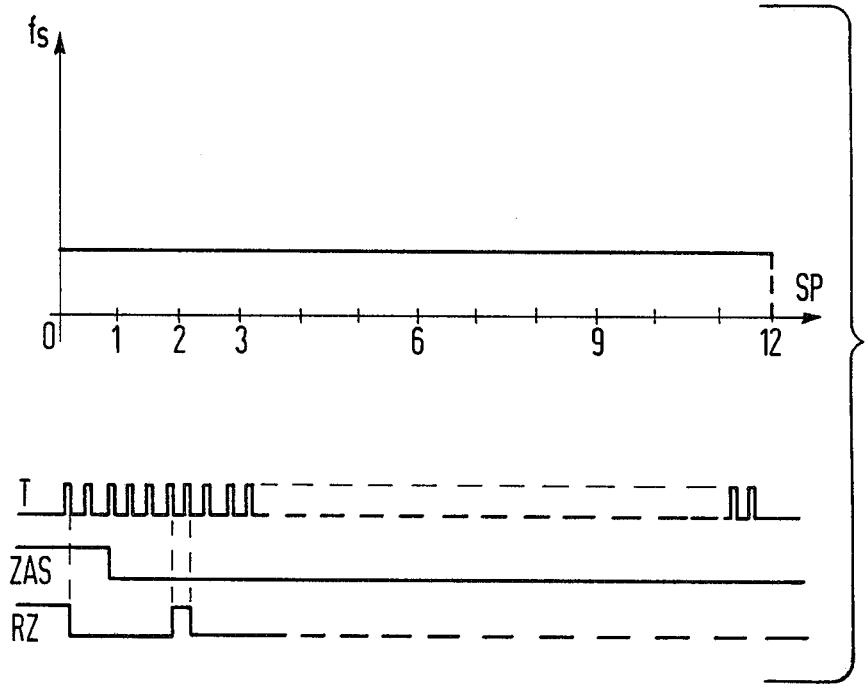
FIG. 2 in a series of graphs depicts the control frequency of the stepping motor versus carriage position upon reversal of carriage movement with the deceleration range and the associated timing, row commence, and coincidence pulses associated therewith.

On the reversal of the direction of movement the carriage may be located in the deceleration region BRB. Then coincidence of the deceleration signal emitted from the third signal generator 10 and the carriage return signal results in the pulse generator of the control unit 12 of the stepping motor 1 setting a constant control frequency fs of approximately 250 Hz for the stepping motor and in the stepping motor 1 being operated at this frequency until the carriage has returned to the start of the row (FIG. 2). The frequency fs must be below the maximum start frequency of the stepping motor permitted at a given load to achieve adequate starting reliability. The column space or interval between the third signal generator 10 and the row-commence position is selected so that the carriage return time through the decelerating region BRB is shorter than the transmission time for sequential "carriage return" and "line feed" signals. At a transmitting speed of 100 Bits per second and a simple blocking step, this time amounts to 140 msec. This ensures that in operation with very short row lengths the keyboard memory store does not need to be large and there is no necessity for fill characters to fill transmission gaps between the "return" and the "feed" signals in, e.g., a telex circuit.

Figure 3:
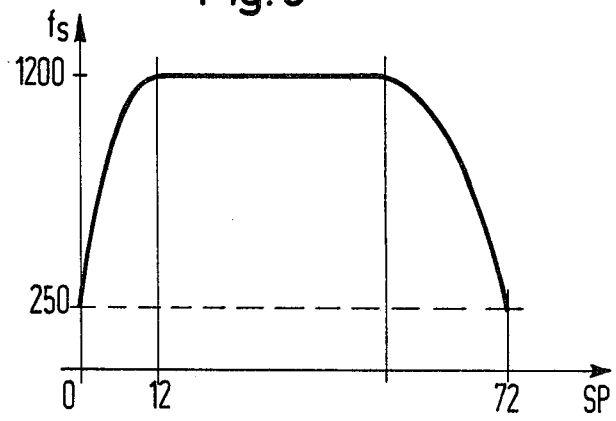
FIG. 3 depicts the control frequency of the stepping motor versus carriage position for carriage return from the end of the row.
Figure 4:
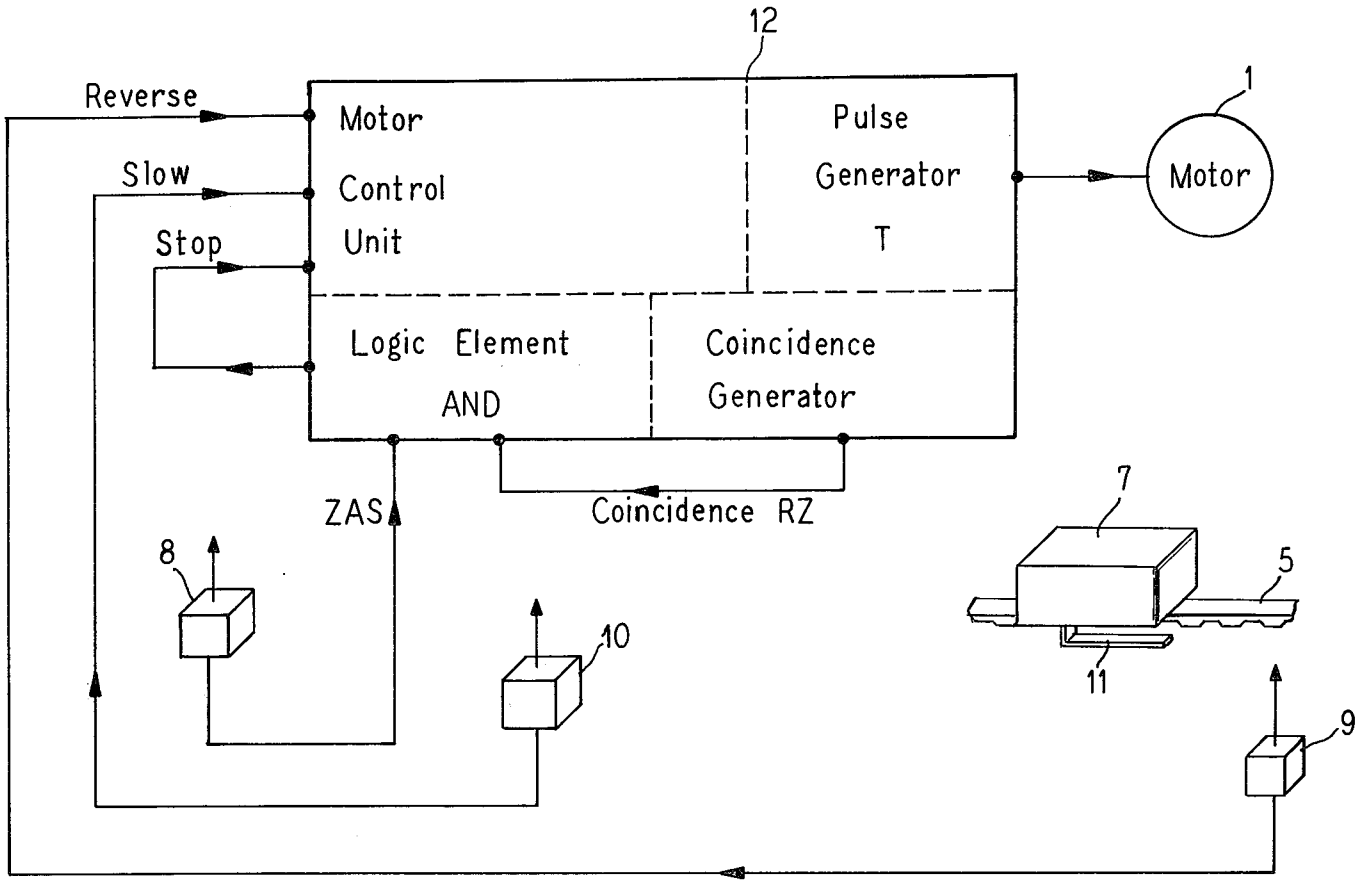
FIG. 4 is a schematic diagram showing electrical connections among the signal generators, motor control unit, and motor of the apparatus.

If, on the other hand, upon reversal of the movement direction the carriage is located outside the decelerating region, i.e., in the accelerating region BEB, it is accelerated by a constant increase in the control frequency fs of the stepping motor. This type of process is known, for example, from the German Offenlegungschrift 2,257,671. When the maximum control frequency of the stepping motor (approximately 1200 Hz) has been reached, the carriage moves at a constant speed. When the carriage reaches the third signal generator 10, the coincidence of the decelerating signal and of the carriage return signal in the control unit 12 of the stepping motor initiates a deceleration program through which the control frequency fs is constantly reduced from the particular value which has been reached to a lower value of approximately 250 Hz. During the acceleration and deceleration of the motor the control frequency of the stepping motor is adjusted so that at the existing load the motor operates at a load angle at which the maximum torque is generated. The time necessary for the acceleration and deceleration of the printer carriage is then a minimum. FIG. 3 shows the course of the control frequency of the stepping motor 1 during the carriage return movement from a full row length, from column 72. The deceleration commences in column 12 and ends in column 0.

In either case, when the printer carriage reaches the position of the first signal generator 8 as it moves to the left and to the beginning of the row, the generator 8 feeds the control unit 12 of the stepping motor 1 with a rowcommence signal ZAS, as represented in FIG. 2. The stepping motor is still supplied with timing pulses T until a specified motor shaft position or pulse count is reached, as indicated by a ring counter in control unit 12 of the stepping motor. At this specified pulse count, a coincidence signal RZ is produced by the ring counter which is linked to the rowcommence signal from the first generator 8 and an AND- logic element in the control unit 12. It is the output signal which results from the coincidence of these two input signals RZ and ZAS which then interrupts the timing pulse sequence T. In FIG. 2, the signal ZAS is already on when the signal RZ occurs (at the left in the Figure); then with both ZAS and RZ activated, the timing pulses T end and the carriage is stopped.

In a preferred stepping motor having a step angle of alpha = 30°, the coincidence signal RZ is produced after every sixth step. Then, six steps of the stepping motor will correspond to a movement of the printer carriage of two columns or 5.08 mm. The fact that the printer carriage is stopped in dependence upon the coincidence of the two signals ZAS and RZ permits a large tolerance in the setting of the row-commence signal generator position and enables the use of a simple signal generator. Nevertheless, the carriage is stopped precisely at the beginning of the printing row.

Although various minor modifications might be suggested by those versed in the art, it should be understood that we wish to embody within the scope of the patent warranted hereon all such modifications as reasonably and properly come within the scope of our contribution to the art.

We claim as our invention:

1. A method for controlling the positioning of a printer carriage wherein a reversible stepping motor drives said carriage in forward and reverse directions along a row and a plurality of signal generators are spaced along said row for selective actuation by said carriage, a first one of said generators being fixed at a selected line-commence location, a second at a line-end location, and a third signal generator at an intermediate location spaced adjacent said line-commence location, said carriage carrying a control strip means for actuating said third generator while said carriage is between said line-commence and intermediate locations, and said motor having a control unit comprising a timing pulse generator, a coincidence signal generator, and an AND-logic circuit, said method comprising the steps:

moving said carriage stepwise in a forward direction, a plurality of steps constituting one type-character space or column;

operating said stepping motor for carriage return in a reverse direction of rotation in its maximum torque range;

generating at intervals a coincidence signal from said coincidence signal generator as a function of timing pulses which govern rotation of the stepping motor;

triggering an output signal from said logic circuit upon carriage return by a coincidence of a signal from said coincidence signal generator and a signal from said first signal generator; and employing said output signal in said control means to terminate said timing pulses from said timing pulse generator to stop the return movement of said carriage selectively adjacent said line-commence location.

* * * * *